US005894118A

United States Patent [19]

Nishimoto et al.

[11] Patent Number: 5,894,118

[45] Date of Patent: Apr. 13, 1999

[54] STRUCTURE OF ROTARY ELECTRONIC DEVICE WITH PUSH/TURN OPERATING BUTTON

[75] Inventors: Takumi Nishimoto; Kenji Kataoka; Jun Sato, all of Tsuyama, Japan

[73] Assignee: Matsushita Electric Industrial Co., Ltd., Osaka, Japan

[21] Appl. No.: 08/861,761

[22] Filed: May 22, 1997

[30] Foreign Application Priority Data

May 23, 1996 [JP] Japan ..... 8-128011
Mar. 12, 1997 [JP] Japan ..... 9-057271

[51] Int. Cl.[6] ..... H01H 19/62; H01H 13/56; H01H 1/52

[52] U.S. Cl. ..... 200/527; 200/523; 200/323

[58] Field of Search ..... 200/564, 566, 200/526, 527, 528, 523, 323–325

[56] References Cited

U.S. PATENT DOCUMENTS

| | | | |
|---|---|---|---|
| 4,383,144 | 5/1983 | Kleeb . | |
| 4,527,024 | 7/1985 | Lai . | |
| 4,771,141 | 9/1988 | Flumingnan et al. . | |
| 4,891,476 | 1/1990 | Nation et al. | 200/11 R |
| 5,043,546 | 8/1991 | Krause . | |
| 5,068,506 | 11/1991 | Suzuki . | |
| 5,310,974 | 5/1994 | Churchill et al. | 200/566 |
| 5,432,312 | 7/1995 | Otani et al. . | |

FOREIGN PATENT DOCUMENTS 60-52563 11/1985 Japan .

*Primary Examiner*—Corrine M. McDermott
*Assistant Examiner*—Michael J. Hayes
*Attorney, Agent, or Firm*—Pollock, Vande Sande & Amernick

[57] ABSTRACT

A rotary electronic device such as a rotary encoder is provided which includes a rotor, a push/turn operating shaft, and a rotary sliding member. The rotor provides electric signals in response to rotation of the push/turn operating shaft and has formed therein a through hole consisting of a circular hole and a cross-shaped hole. The push/turn operating shaft includes a small diameter end portion and a cross-shaped portion engaging the cross-shaped hole of the rotor for rotating the rotor according to the rotation of the push/turn operating shaft. The rotary sliding member is connected to the small diameter end portion of the push/turn operating shaft in engagement with tapered end surfaces of the cross-shaped portion of the push/turn operating shaft within the cross-shaped hole of the rotor and slides onto tapered end surfaces formed on an inner wall of the rotor between the circular hole and the cross-shape hole to hold the push/turn operating shaft in push-in position when the push/turn operating shaft is pushed into the rotor to move the rotary sliding member out of the cross-shaped hole of the rotor.

6 Claims, 17 Drawing Sheets

X-X CROSS SECTION

Y-Y CROSS SECTION

X-X CROSS SECTION

Y-Y CROSS SECTION

X-X CROSS SECTION

Y-Y CROSS SECTION

STRUCTURE OF ROTARY ELECTRONIC DEVICE WITH PUSH/TURN OPERATING BUTTON

BACKGROUND OF THE INVENTION

1. Technical Field

The present invention relates generally to a rotary electronic device such as a rotary encoder which includes a push/turn operating button designed to be locked in a push-in position by finger pressure of an operator and returned to an unlocked position by depressing it again.

2. Background of Related Art

Modern electronic equipment is becoming small in area of a front control panel for reduction in size thereof and increasing in number of electronic parts for advancement of the electronic equipment. This gives rise to a problem in that an interval between adjacent two of operating buttons of electronic devices is shortened so that when an operator moves the operating button of one of the devices, a fingertip of the operator may interfere with another of the devices.

In order to avoid the above problem, an improved electronic device may be used which is designed to lock in push-in positions some of operating buttons not required to be moved, while maintaining the others in projecting positions for ease of manual operations.

FIGS. 16 to 19 show a conventional rotary encoder as one example of the above described electronic device.

The rotary encoder includes generally an encoding mechanism 1 shown on the right side of the line A—A and a locking mechanism 2 shown on the left side of the line A—A.

The encoding mechanism 1 includes, as shown in FIG. 17(*a*), an operating shaft 3 and a resinous rotor 5. The operating shaft 3 is retained by a bearing 4 so as to be rotatable and movable in an axial direction. The rotor 5 engages a semicircular portion 3A of the operating shaft 3 so that it is rotatable along with rotation of the operating shaft 3, but restricted from moving in the axial direction of the operating shaft 3.

On a rear surface of the rotor 5, a rotary contact plate 6, as shown in FIG. 19, consisting of a central ring portion 6A and radially extending fins 6B is provided in insert molding. Three resilient contacts 8A, 8B, and 8C which extend from an insulating substrate 7 disposed at a given interval away from the rotary contact plate 6, elastically engage the central ring portion 6A and one of the radially extending fins 6B.

The encoding mechanism 1 is enclosed with a metallic cover 9. The cover 9 has, as shown in FIG. 16, claws 9A bent to connect the encoding mechanism 1 with the locking mechanism 2 together with the insulating substrate 7.

FIG. 17(*a*) shows an unlocked position of the operating shaft 3. The rotation of the operating shaft 3 causes the rotor 5 to be rotated so that the resilient contacts 8A to 8C slide on the central ring portion 6A and the radially extending fins 6B to produce pulse signals between terminals D and E and between terminals D and F connected to the contacts 8A to 8C.

The locking mechanism 2 has substantially the same structure as that taught in Japanese Patent Second Publication No. 60-52563. Specifically, the locking mechanism 2 includes a locking member 11 disposed within a box-like cover 10 which is moved by the axial movement of the operating shaft 3 against a spring force of a coil spring 12. The operating shaft 3 , as shown in FIG. 18, engages at a groove 3B an opening 11A of the locking member 12.

A hook 15 is installed in a bottom plate 13 of the cover 10. The hook 15 has a pin 14 which is urged inward of the cover 10 by a plate spring 16 at all times and which selectively establishes engagement and disengagement with and from a heart-shaped groove 11B formed in the locking member 11 according to the axial movement of the locking member 11 in a locked position and an unlocked position as shown in FIGS. 17(*a*) and 17(*b*).

The rotary encoder is usually installed in electronic equipment, as shown in FIG. 16, by soldering a mounting leg 10A extending from a rear end portion of the cover 10 and terminals 8D to 8F extending from the insulating substrate 7 to a printed-circuit board 18 extending perpendicular to a front control panel 17 or parallel to the operating shaft 3. However, in modern reduced-size electronic equipment, electronic parts are required to be small in size and installed on a printed-circuit board disposed parallel to the front control panel 17 or perpendicular to the operating shaft 3. The above conventional rotary encoder has the locking mechanism 2 disposed behind the encoder mechanism 1 and thus does not meet such requirements.

SUMMARY OF THE INVENTION

It is therefore a principal object of the present invention to avoid the disadvantages of the prior art.

It is another object of the present invention to provide a compact rotary electronic device with an operating button locking mechanism which is designed to be mountable on a printed-circuit board installed within an electronic device parallel to a front control panel.

According to one aspect of the present invention, there is provided a rotary electronic device which comprises: (a) a rotor having disposed thereon a rotary contact plate which establishes electrical communication with a plurality of contacts according to rotation of the rotor; (b) a hole formed in the rotor extending along an axis of rotation of the rotor, the hole including a non-circular portion and a circular portion, the non-circular portion being defined by a plurality of ridges which are formed on an inner wall of the rotor and which extend along the axis of rotation of the rotor at given interval away from each other to define a plurality of guide grooves therebetween, the ridges having slant end surfaces exposed to the circular portion, oriented at a given angle to the axis of rotation of the rotor; (c) an operating shaft disposed within the hole so as to be rotatable along with the rotor and movable in a direction of the axis of rotation of the rotor, the operating shaft including a small diameter portion and a large diameter portion, the large diameter portion having formed thereon a plurality of ridges extending in a lengthwise direction thereof engaging the guide grooves formed in the inner wall of the rotor, the ridges having wedge-shaped end surfaces exposed to the circular portion of the hole; (d) a rotary sliding member having an annular portion into which the small diameter portion of the operating shaft is fitted and a plurality of sliders formed on an outer wall of the annular portion, the sliders having tapered end surfaces oriented in angle in the same direction of the slant end surfaces of the ridges formed on the inner wall of the rotor; and (e) an urging means for urging the rotary sliding member into engagement of the tapered end surfaces of the sliders with the wedge-shaped end surfaces of the operating shaft and the slant end surfaces of the ridges formed on the inner wall of the rotor according to movement of the operating shaft through the hole to establish a locked position and an unlocked position of the operating shaft, respectively.

In the preferred mode of the invention, a push/turn button is further provided on an end of the operating shaft which has a diameter greater than that of the operating shaft. A coil spring is disposed between the rotor and the push/turn button for holding the operating shaft in the unlocked position.

The push/turn button has formed therein a chamber within which an end portion of the coil spring is disposed.

The non-circular portion of the hole and the large diameter portion of the operating shaft are of cross-shape and contoured to each other.

An insulating casing supporting the rotor rotatably and a switching assembly are further provided. The switching assembly includes a plurality of stationary contacts provided on and end surface of the insulating casing and a movable contact urged into constant engagement with the stationary contacts to establish electric communication between the stationary contacts. The movable contact is brought into disengagement from the stationary contacts by the movement of the operating shaft from the unlocked position to the locked position.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings:

FIG. 3(*b*) is a cross sectional view taken along the line X—X in FIG. 3(*a*);

FIG. 3(*c*) is a front view which shows a rotor of the rotary encoder in FIG. 1;

FIG. 3(*d*) is a cross sectional view taken along the line Y—Y in FIG. 3(*a*);

FIG. 4(*b*) is a front view of the push/turn operating shaft in FIG. 4(*a*);

FIG. 5(*b*) is a cross sectional view taken along the line X—X in FIG. 5(*a*);

FIG. 5(*c*) is a cross sectional view taken along the line Y—Y in FIG. 5(*a*);

FIG. 14(*b*) is a cross sectional view taken along the line X—X in FIG. 14(*a*);

FIG. 14(*c*) is a cross sectional view taken along the line Y—Y in FIG. 14(*a*);

FIG. 17(*b*) is a cross sectional view which shows a locked position of an operating shaft of the conventional rotary encoder in FIG. 16;

DESCRIPTION OF THE PREFERRED EMBODIMENT

Figure 1:
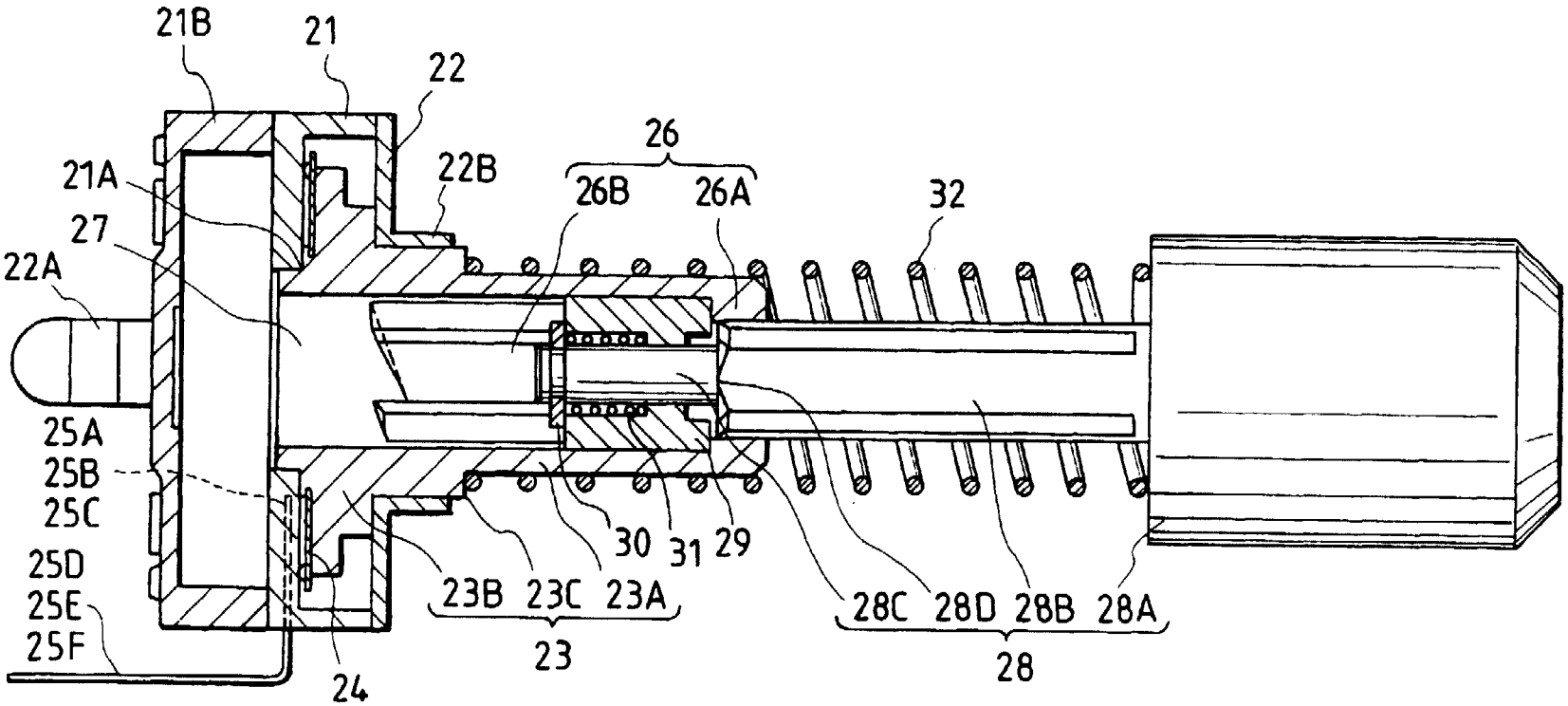
FIG. 1 is a partially cross sectional view which shows a rotary encoder according to the first embodiment of the present invention.
Figure 2:
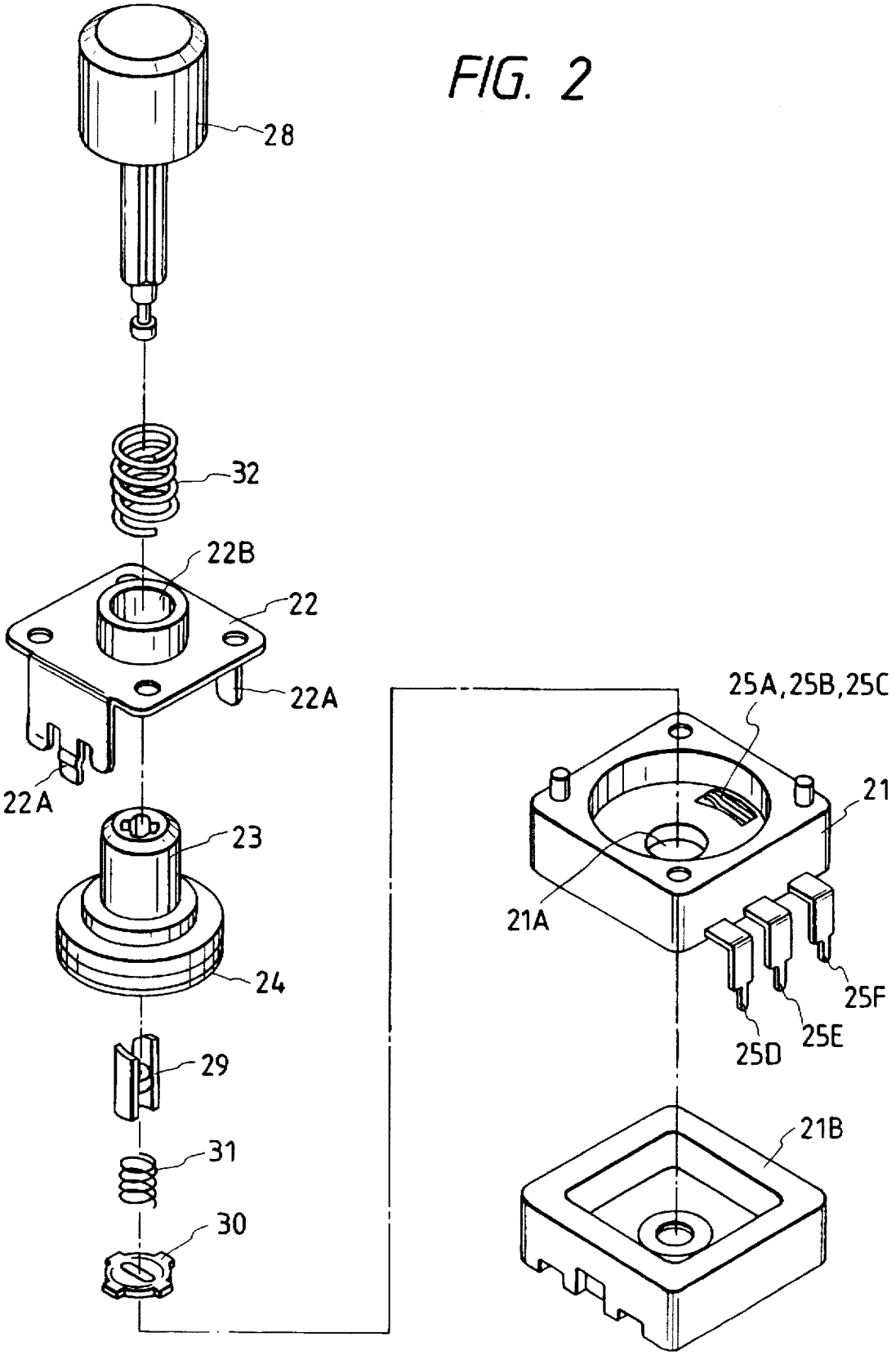
FIG. 2 is an exploded perspective view of the rotary encoder in FIG. 1.
Figure 3A:
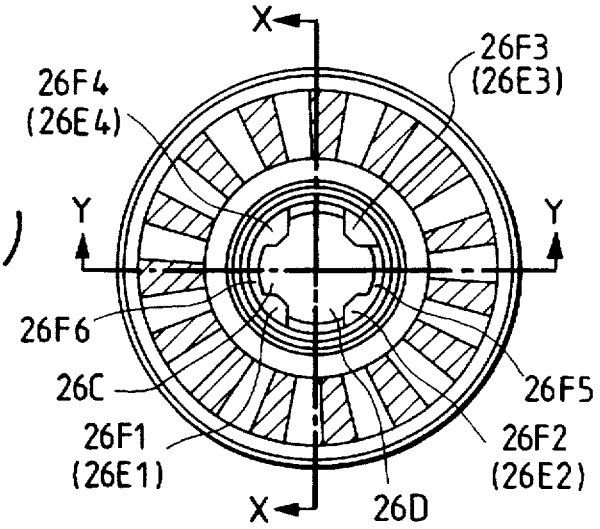
FIG. 3(*a*) is a bottom view which shows a rotor of the rotary encoder in FIG. 1.
Figure 3B:
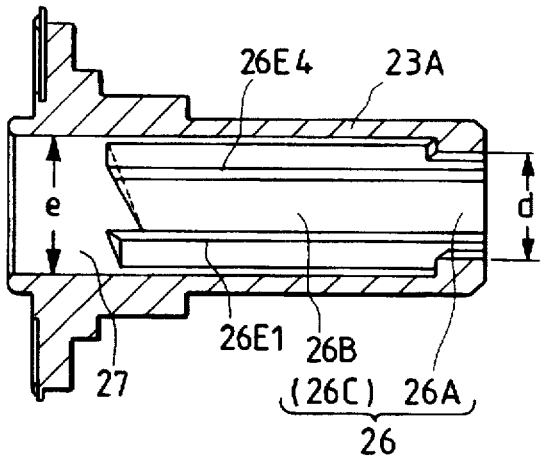
Figure 3C:
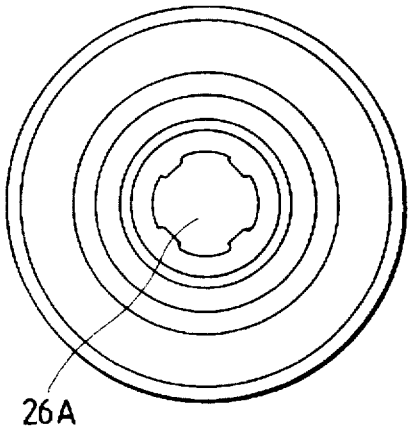
Figure 3D:
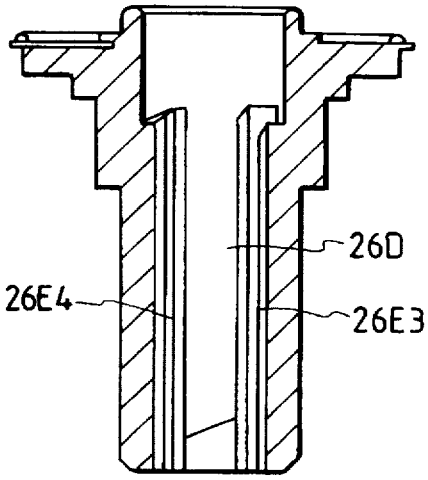

Referring now to the drawings, wherein like reference numbers refer to like parts throughout several views, particularly to FIGS. 1 and 2, there is shown a rotary encoder according to the first embodiment of the invention.

The rotary encoder includes generally an encoder mechanism and a locking mechanism. The encoder mechanism includes a resinous insulating casing 21, a metallic cover 22, a resinous rotor 23, and a rotary contact plate 24.

The insulating casing 21 has an opening closed by the cover 22. The cover 22 has, as clearly shown in FIG. 2, mounting legs 22A extending perpendicular to a major portion thereof. The rotor 23 is supported rotatably by the casing 21 and consists of a cylindrical shaft 23A and a disc 23B. The cylindrical shaft 23A is retained at the periphery thereof rotatably in a central opening 22B formed in the cover 22. The disc 23B is supported at a rear boss thereof rotatably in a circular opening 21A formed in the bottom of the casing 21.

The rotary contact plate 24 is installed on the bottom of the disc 23B in the insert molding. Three contacts 25A, 25B, and 25C which extend from the bottom of the casing 21 engage the rotary contact plate 24 elastically in a conventional manner. Three terminals 25D, 25E, and 25F leading to the contacts 25A, 25B, and 25C extend rearward from a side end portion of the casing 21.

The operation of the encoding mechanism is the same as that discussed in the introductory part of this application, and explanation thereof in detail will be omitted here.

A resinous support cover 21B is attached to the bottom of the casing 21 and serves as a base for installation of the rotary encoder on a printed-circuit board of an electronic device through the mounting legs 22A.

The locking mechanism includes a through hole, as shown in FIGS. 3(*a*) to 3(*d*) formed in the cylindrical shaft 23A of the rotor 23. The through hole consists of a cross-shaped hole 26 and a circular hole 27. The cross-shaped hole 26 also consists of a front portion 26A and a rear portion 26B. The front portion is defined by four guide grooves, as shown in FIG. 3(*c*), each extending at an interval "d" away from opposite one of them. The rear portion 26B is defined by a first pair of opposed guide grooves 26C and a second pair of opposed guide grooves 26D. The opposed guide grooves 26C of the first pair extend from two of the four guide grooves of the front portion 26A of the cross-shaped hole 26 at the same interval "d" away from each other toward the circular hole 27 having the diameter "e". The opposed guide grooves 26D of the second pair extend from the other two of the four guide grooves of the front portion 26A of the cross-shaped hole 26 at an interval "e" greater than the interval "d" toward the circular hole 27 having the diameter "e".

Four ridges 26E1, 26E2, 26E3, and 26E4 formed along an inner wall of the cross-shaped hole 26 which define the opposed guide grooves 26C and 26D, have slant rear end surfaces 26F1, 26F2, 26F3, and 26F4 which are oriented at the same angle to the longitudinal center line (i.e., an axis of rotation) of the rotor 23 in a circumferential direction of the rotor 23. The slant rear end surfaces 26F1 and 26F3 opposed to each other are exposed to the opposed guide grooves 26D, respectively. The slant rear end surfaces 26F2 and 26F4 opposed to each other extend to side walls of the ridges 26E3 and 26E1 through slant stepped inner walls 26F5 and 26F6 having a width of half the difference in interval between the guide grooves 26C and 26D (i.e., (e−d)/2).

Figure 4B:
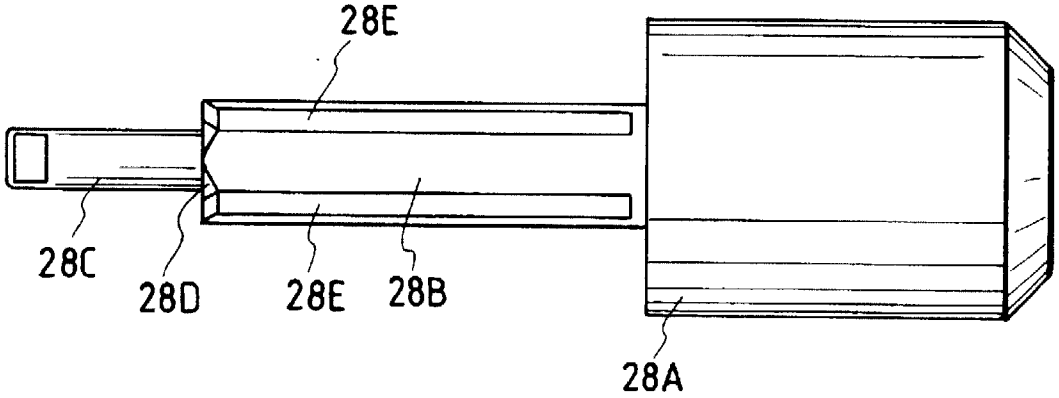
FIG. 4(*a*) is a bottom view which shows a push/turn operating shaft.
Figure 4A:
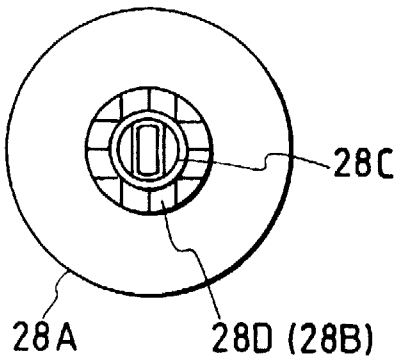

The locking mechanism also includes a push/turn operating shaft 28 made of metallic material in die-casting. The push/turn operating shaft 28 includes, as shown in FIGS. 4(*a*) and 4(*b*), an operating button 28A, a cross-shaped shaft 28B, and a circular shaft 28C. The operating button 28A is formed on an end of the cross-shaped shaft 28B. The circular shaft 28C has a diameter smaller than that of the cross-shaped shaft 28B. The cross-shaped shaft 28B has formed thereon four ridges 28E and, when the push/turn operating shaft 28 is in an unlocked position as shown in FIG. 1, engages the guide grooves in the first portion 26A of the cross-shaped hole 26 of the rotor 23. Each of the ridges 28E has a wedge-shaped end surface 28D.

Figure 5A:
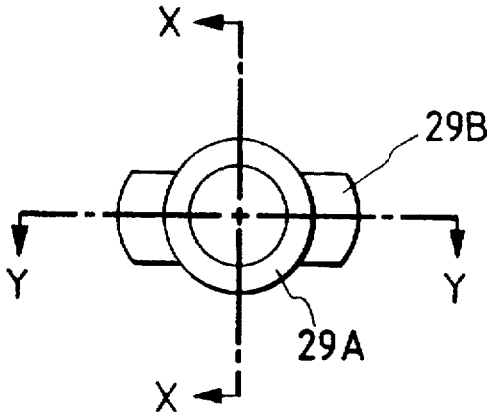
FIG. 5(*a*) is a bottom view which shows a rotary sliding member.
Figure 5B:
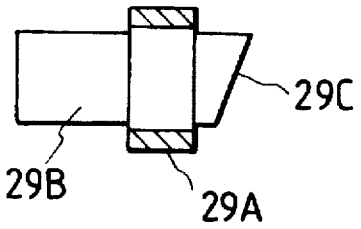
Figure 5C:
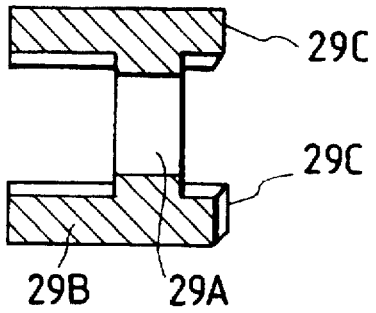
Figure 6A:
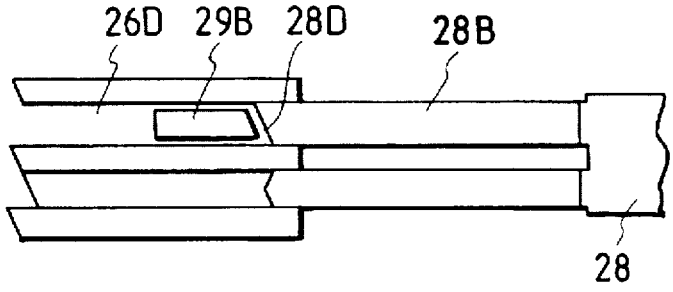
FIGS. 6(*a*) to 6(*d*) are schematic illustrations which show sequential operations of a locking mechanism of a rotary encoder.
Figure 6B:
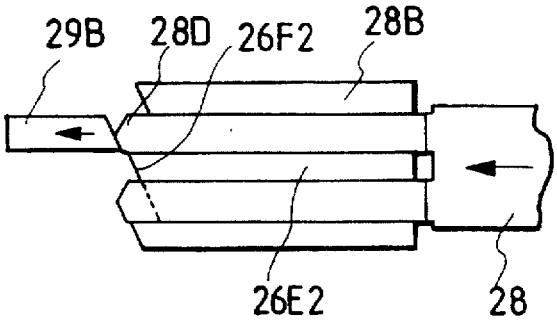
Figure 6C:
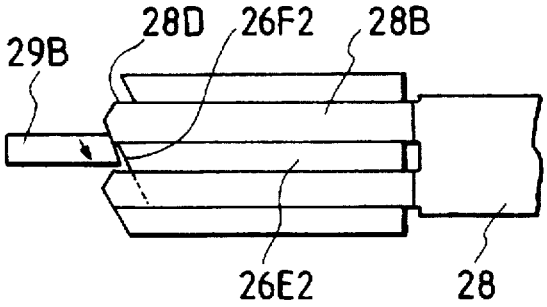
Figure 6D:
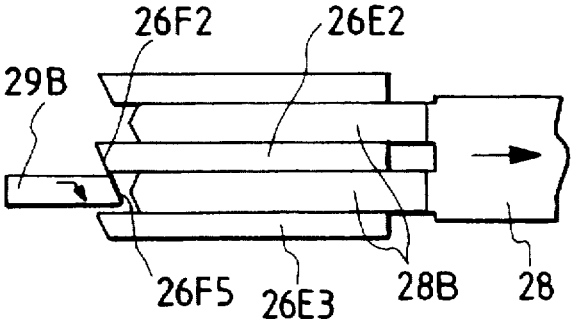

The circular shaft 28C of the push/turn operating shaft 28 is, as shown in FIG. 2, inserted into a rotary sliding member 29 rotatably and slidably in the axial direction within a given range according to manual rotation and axial movement of the operating button 28A by an operator. The rotary sliding member 29 includes, as shown in FIGS. 5(*a*) to 5(*c*), a central annular portion 29A and a pair of fins 29B connected to the periphery of the central annular portion 29A in parallel to each other.

The diameter of the rotary sliding member 29 and the width of the fins 29B are so determined that the fins 29B may slide along the guide grooves 26D in the cross-shaped hole 26 which are opposed at the greater interval "e". The fines 29B have tapered end surfaces 29C which are oriented at the same angle to the longitudinal center line of the rotary sliding member 29 in a circumferential direction. Specifically, the tapered end surfaces 29C are so formed as to coincide with opposed two of the slant rear end surfaces 26F1 to 26F4 of the ridges 26E1 to 26E4. The rotary sliding member 29 is retained within the cross-shaped hole 26 by a clip plate 30, as shown in FIGS. 1 and 2, crimped on the end of the circular shaft 28C of the push/turn operating shaft 28. A coil spring 31 is disposed between the clip plate 30 and the annular portion 29A of the rotary sliding member 29 to urge the tapered end surfaces 29C into constant engagement with the wedge-shaped end surfaces 28D of the cross-shaped shaft 28B.

A coil spring 32 is disposed between the operating button 28A and a shoulder portion 23C of the rotor 23 to urge the push/turn operating shaft 28 outward (i.e., in the right direction in the drawing) at all the time. The depression of the operating button 28A of the push/turn operating shaft 28 against a spring force of the coil spring 32, thus, causes the push/turn operating shaft 28 to be pushed into the rotor 23 and then held in a locked position. Further depression of the operating button 28A causes the push/turn operating shaft 28 to be unlocked as will be described later in detail.

FIGS. 6(*a*) to 6(*d*) schematically show a sequence of operations of the locking mechanism when locking and unlocking the push/turn operating shaft 28.

FIG. 6(*a*) shows the unlocked position of the push/turn operating shaft 28. The push/turn operating shaft 28 is, as described above, urged by the coil spring 32 outward at all the time so that the rotary sliding member 29 secured on the circular shaft 28C is urged outward by the coil spring 31. Specifically, the rotary sliding member 29 is, as shown in the drawing, disposed at the fines 29B within the opposed guide grooves 26D of the rotor 23 and placed in constant engagement with shoulders formed between the front and rear portions 26A and 26B of the cross-shaped hole 26.

When the operating button 28A of the push/turn operating shaft 28 is depressed by finger pressure of the operator inward against the spring force of the coil spring 32, it will cause the fins 29B of the rotary sliding member 29 to be moved, as shown in FIG. 6(*b*), backward (i.e., the left direction in the drawing) along the opposed guide grooves 26D and then dislodged therefrom.

Upon dislodgment of the fins 29B from the opposed guide grooves 26D, the fins 29B slide, as shown in FIG. 6(*c*), along tapered surfaces of the wedge-shaped end surfaces 28D of the cross-shaped shaft 28B of the push/turn operating shaft 28 toward the slant rear end surfaces 26F2 and 26F4 of the ridges 26E2 26E4 of the cylindrical shaft 23A with aid of the spring force of the coil spring 31.

Figure 7:
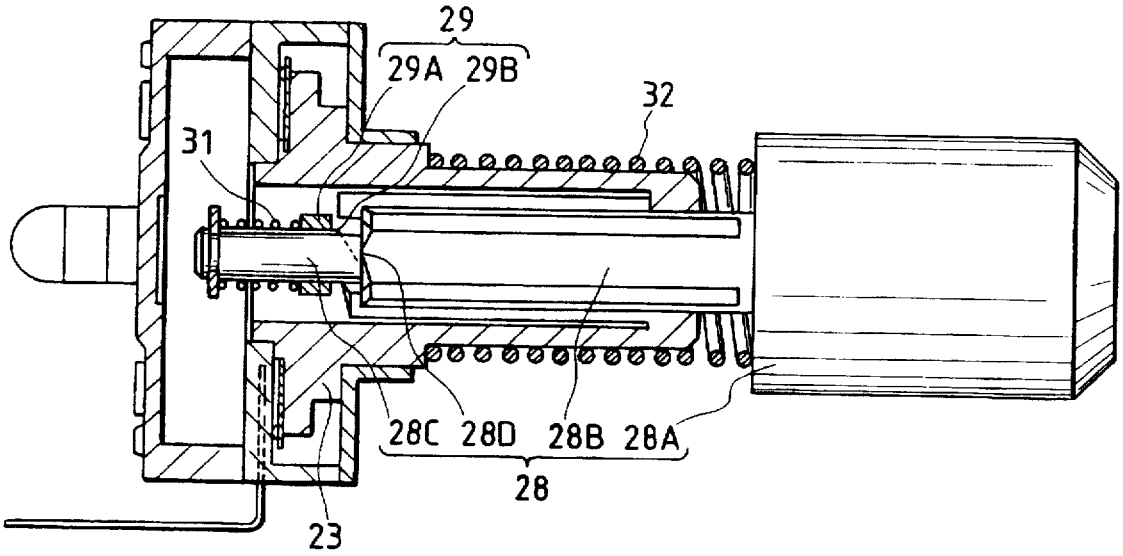
FIG. 7 is a partially cross sectional view which shows a locked position of a push/turn operating shaft.

When the finger pressure on the operating button 28A of the push/turn operating shaft 28 is released, the push/turn operating shaft 28 is urged outward by the spring force of the coil spring 32 so that the fins 29B slide, as shown in FIG. 6(*d*), along the slant stepped inner walls 26F5 and 26F6 and stop at the side walls of the ridges 26E3 and 26E1. Specifically, the push/turn operating shaft 28 is held in the locked position, as shown in FIG. 7, 90° away from the unlocked position shown in FIG. 6(*a*), thereby allowing the rotor 23 to be rotated according to rotation of the operating button 28A of the push/turn operating shaft 28.

When the operating button 28A of the push/turn operating shaft 28 is depressed inward again, it will cause the fins 29B of the rotary sliding member 29 to be rotated further through 90° over the slant rear end surfaces 26F3 and 26F1 so that they fall into the opposed guide grooves 26D, thereby bringing the push/turn operating shaft 28 into the unlocked position as shown in FIG. 6(*a*).

Figure 8:
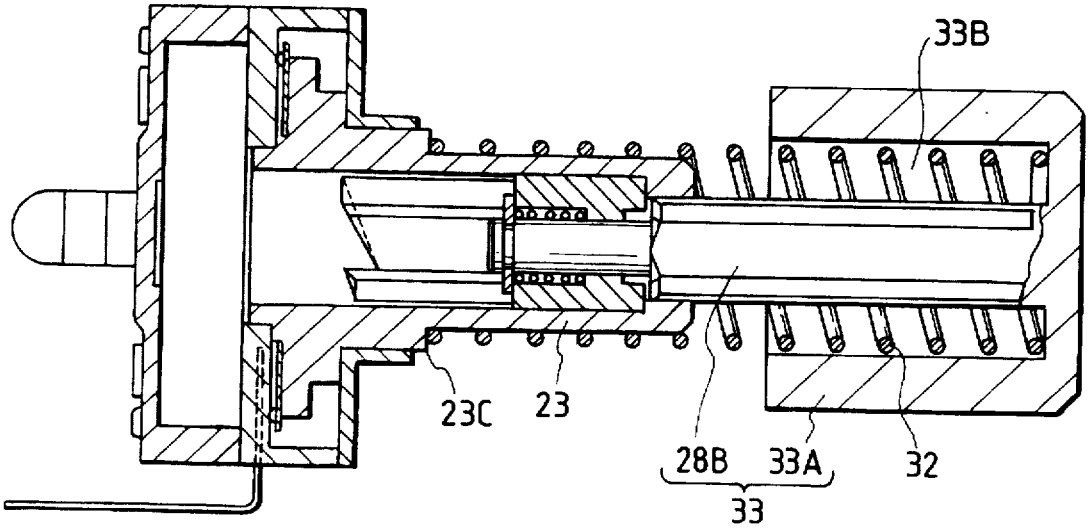
FIG. 8 is a partially cross sectional view which shows a rotary encoder according to the second embodiment of the present invention.

FIG. 8 shows the second embodiment of the rotary encoder according to the invention which is different from that of the first embodiment only in structure of a push/turn operating shaft 33. Other arrangements are identical, and explanation thereof in detail will be omitted here.

Specifically, the push/turn operating shaft 33 includes a cap-shaped button 33A defining therein a cylindrical chamber 33B. The top of the cross-shaped shaft 28B is connected to an inner end wall of the button 33A. The coil spring 32 is disposed between the inner end wall of the button 33A and the shoulder portion 23C of the rotor 23.

This structure allows the push/turn operating shaft 33A to be decreased in overall length as compared with the first embodiment. Moreover, the button 33A covers substantially half the length of the coil spring 32, thereby avoiding unwanted deformation of the coil spring 32 during axial movement of the push/turn operating shaft 33.

Figure 9:
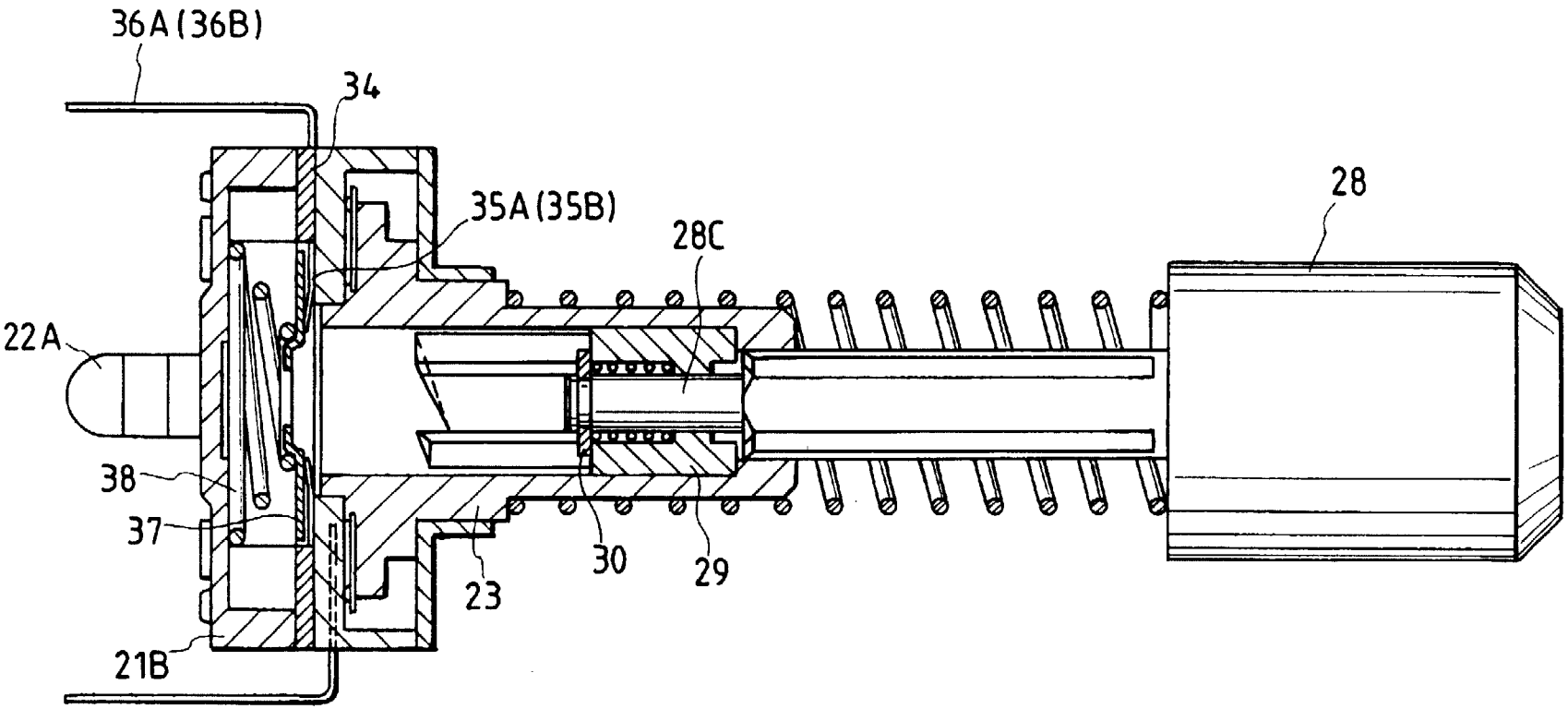
FIG. 9 is a partially cross sectional view which shows a rotary encoder according to the third embodiment of the present invention.

FIG. 9 shows the third embodiment of the rotary encoder according to the invention which has a switching unit actuated by axial movement of the push/turn operating shaft 28.

Figure 10:
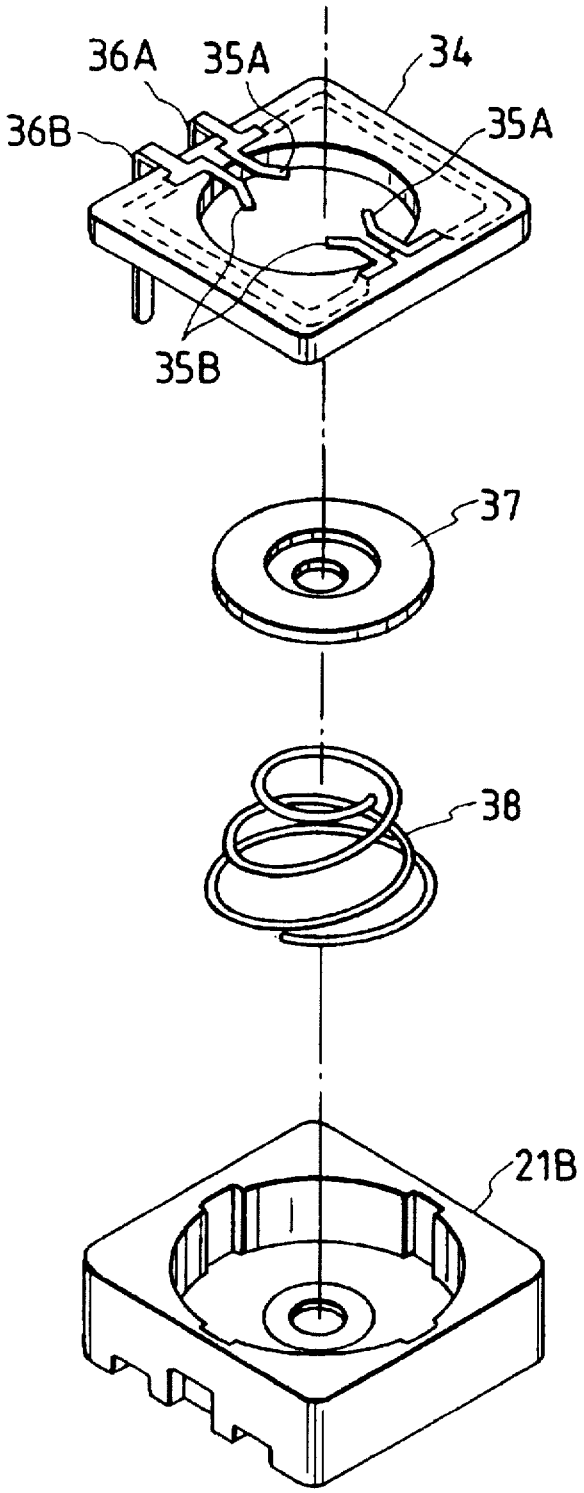
FIG. 10 is an exploded perspective view which shows a switching unit installed in a rotary encoder of the third embodiment.

The switching unit includes, as shown in FIG. 10, a switch substrate 34, two pairs of elastic stationary contacts 35A and 35B, a movable contact 37, and a cone-shaped coil spring 38.

The stationary contacts 35A and 35B are connected to terminals 36A and 36B extending outside the support cover 21B as shown in FIG. 9. The movable contact 37 is made of a metallic disc. The coil spring 38 is disposed within the support cover 21B to urge the movable contact 37 into constant engagement with the stationary contacts 35A and 35B to establish electrical communication between the pairs of the stationary contacts 35A and 35B.

Figure 11:
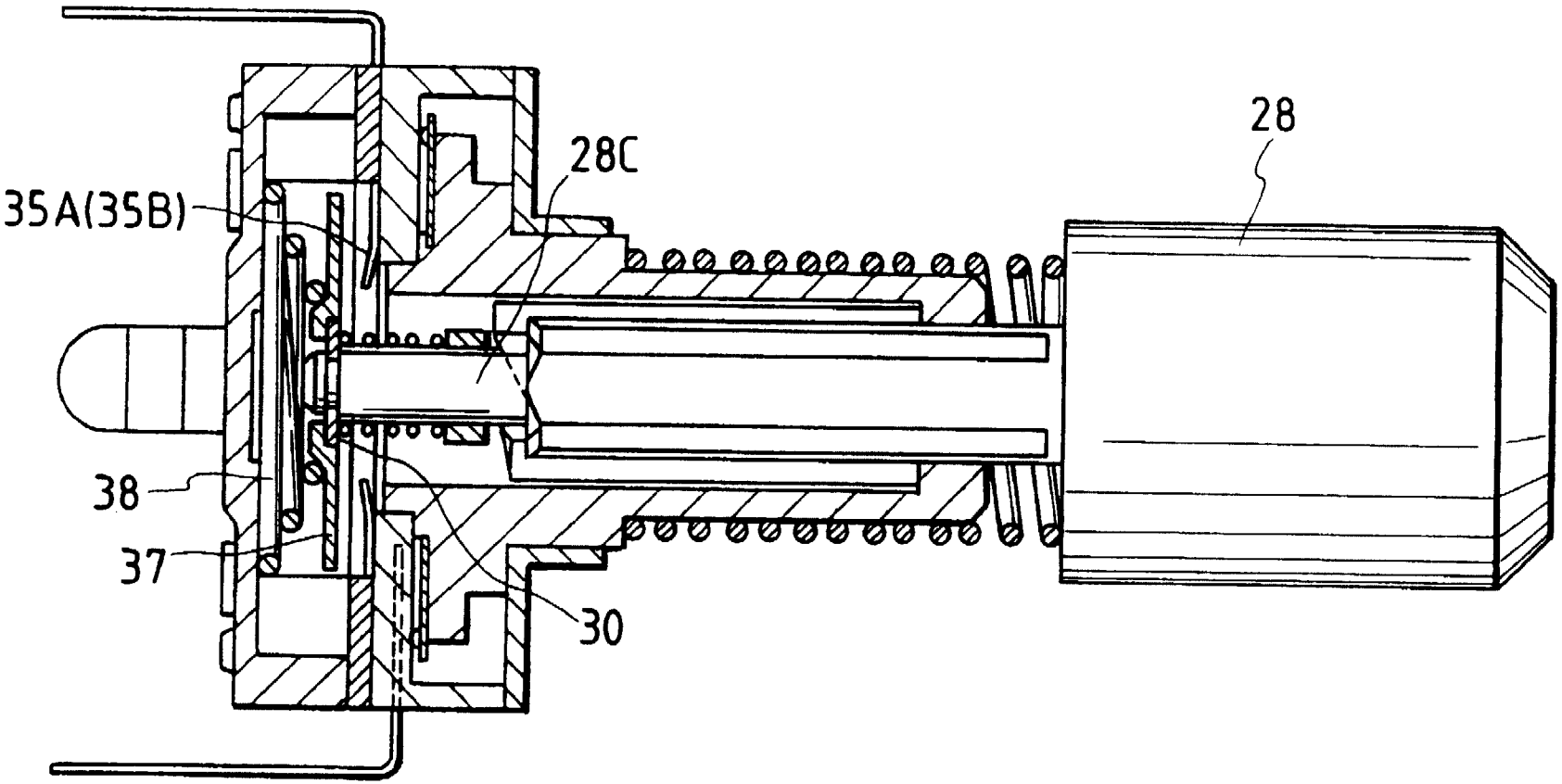
FIG. 11 is a partially cross sectional view which shows a locked position of a push/turn operating shaft in which the switching unit shown in FIG. 10 is opened.

In operation, when the push/turn operating shaft 28 is depressed and brought into the locked position, it will cause the clip plate 30 installed on the circular shaft 28C to engage a central recess formed in the movable contact 37 to move it, as shown in FIG. 11, away from the stationary contacts 35A and 35B against the spring force of the coil spring 38, thereby blocking the electrical communication between the stationary contacts 35A and 35B. Upon release of the push/turn operating shaft 28, the rotary sliding member 29 is held within the rotor 23 in the locked position, similar to the above embodiments.

When the push/turn operating shaft 28 is depressed further from the locked position, it is returned back to the unlocked position, as shown in FIG. 9, in the same way as discussed in the first embodiment to establish the electrical communications between the stationary contacts 35A and 35B again.

Figure 12:
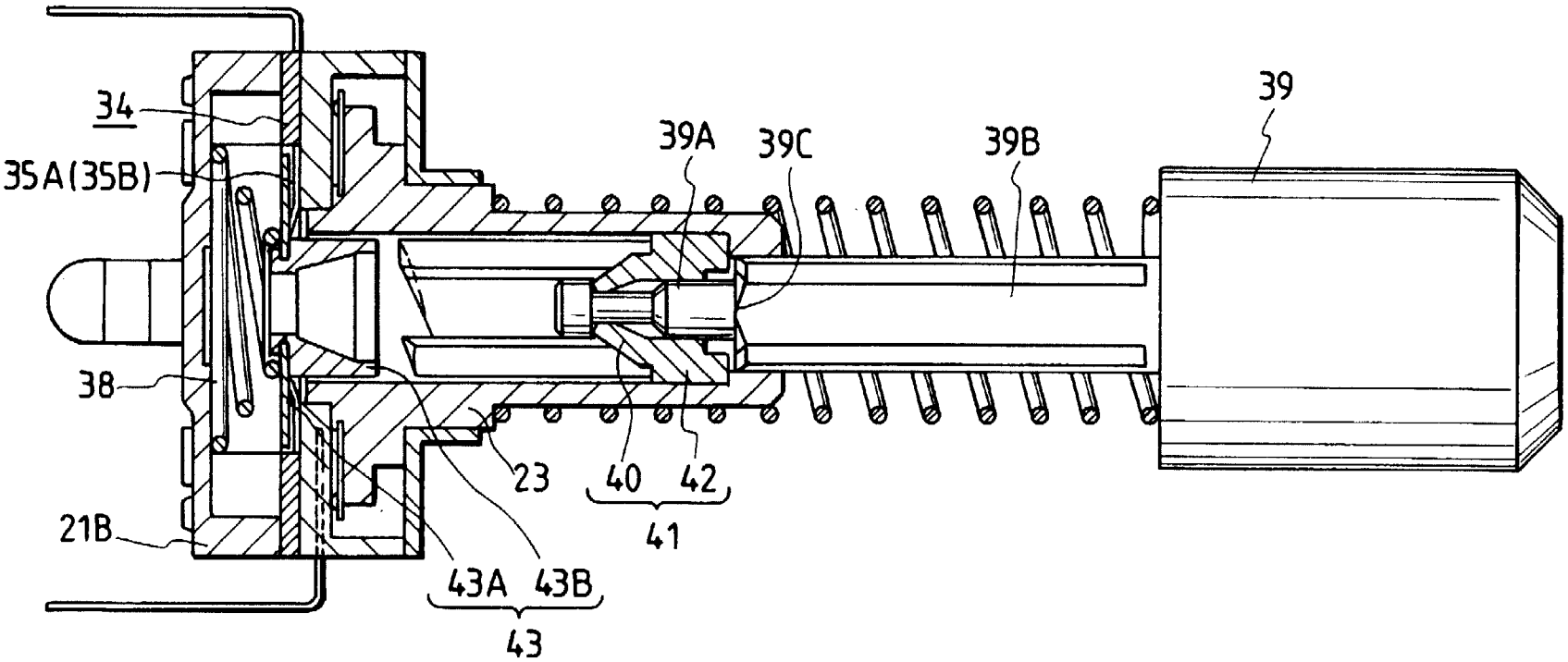
FIG. 12 is a partially cross sectional view which shows a rotary encoder according to the fourth embodiment of the present invention.
Figure 13:
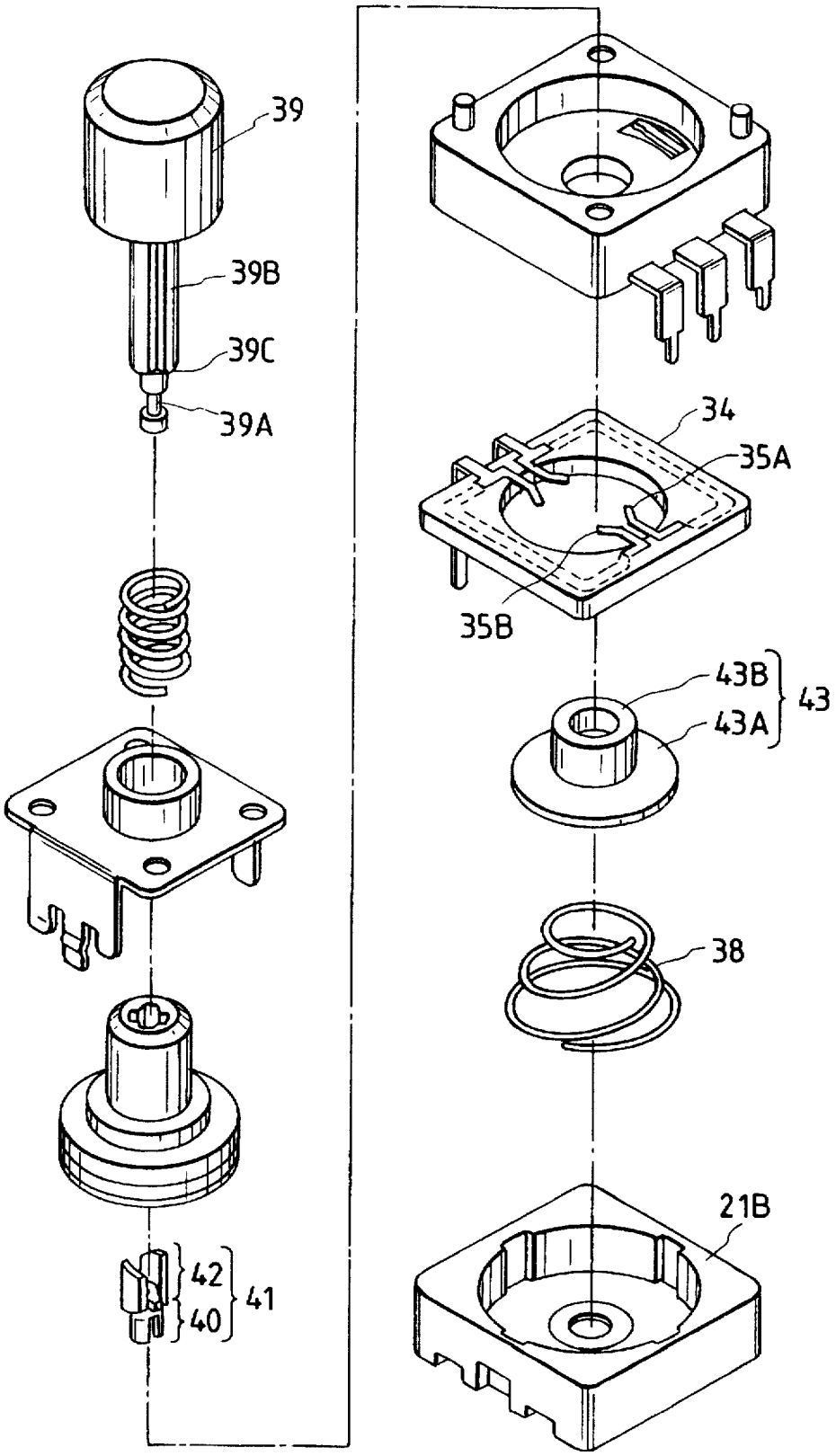
FIG. 13 is an exploded perspective view which shows the rotary encoder in FIG. 12.
Figure 14A:
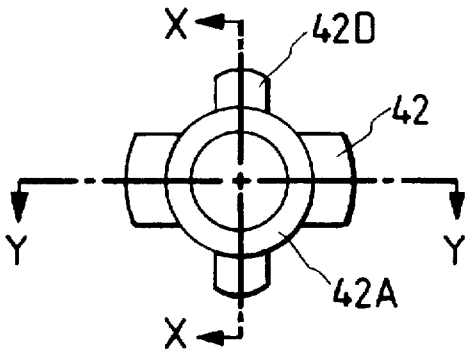
FIG. 14(*a*) is a bottom view which shows a rotary sliding member of the fourth embodiment.
Figure 14B:
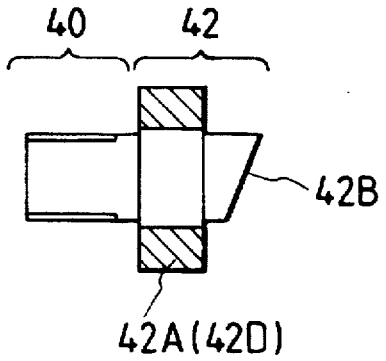
Figure 14C:
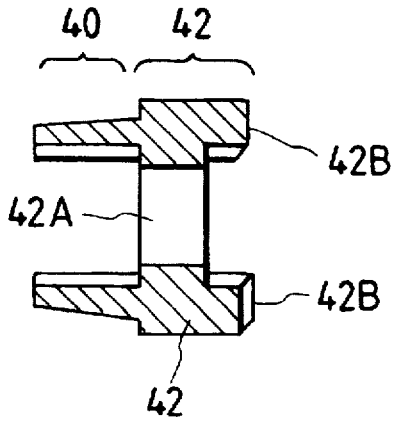

FIGS. 12 to 14 show the fourth embodiment of the rotary encoder of the invention which is different from that of the third embodiment, as shown in FIGS. 9 to 11, in structure of the locking mechanism.

A push/turn operating shaft 39 includes a circular shaft 39A and a cross-shaped shaft 39B identical in structure with the cross-shaped shaft 28B in the above embodiments. A rotary sliding member 41 includes, as shown in FIGS. 12 and 13, a cone-shaped portion 40, a pair of fins 42, and a pair of protrusions 42D. The cone-shaped portion 40 has formed therein a slit and engages a small diameter portion formed in an end portion of the circular shaft 39A so that the rotary sliding member 41 can rotate and slide along the circular shaft 39A within a given range. The fins 42 are substantially identical in structure with the fins 29B of the rotary sliding member 29 of the above embodiments. Specifically, the fins 42 have tapered end surfaces 42B oriented in the same direction in a circumferential direction of the rotary sliding member 41 and are opposed diametrically across a central annular portion 42A. The tapered end surfaces 42B are urged by elasticity of the cone-shaped portion 40 into constant engagement with the wedge-shaped end surfaces of the push/turn operating shaft 39. Each of the protrusions 42D is formed on the central annular portion 42A at right angles to the fins 42.

The switching unit is different from that in the one shown in FIG. 10 only in a movable contact 43, and other arrangements are identical. The movable contact 43 includes a flange 43A and a boss 43B. The flange 43A is installed in an end of the boss 43B in the insert molding and urged by the coil spring 38 into constant engagement with the stationary contacts 35A and 35B attached to the switch substrate 34.

Figure 15:
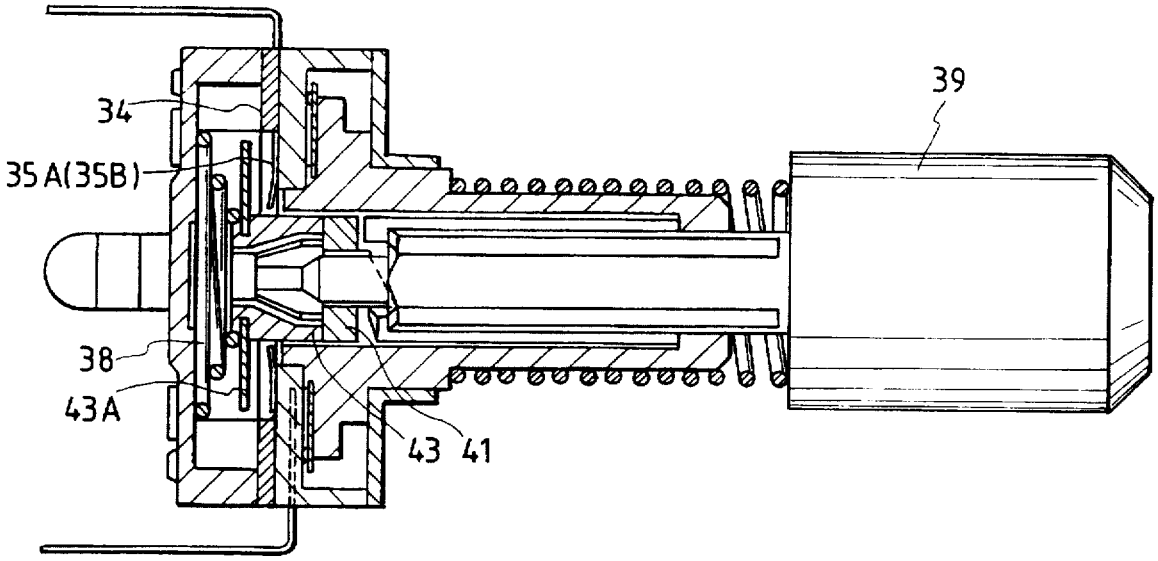
FIG. 15 is a partially cross sectional view which shows a locked position of a push/turn operating shaft in which the switching unit shown in FIGS. 12 and 13 is opened.
Figure 16:
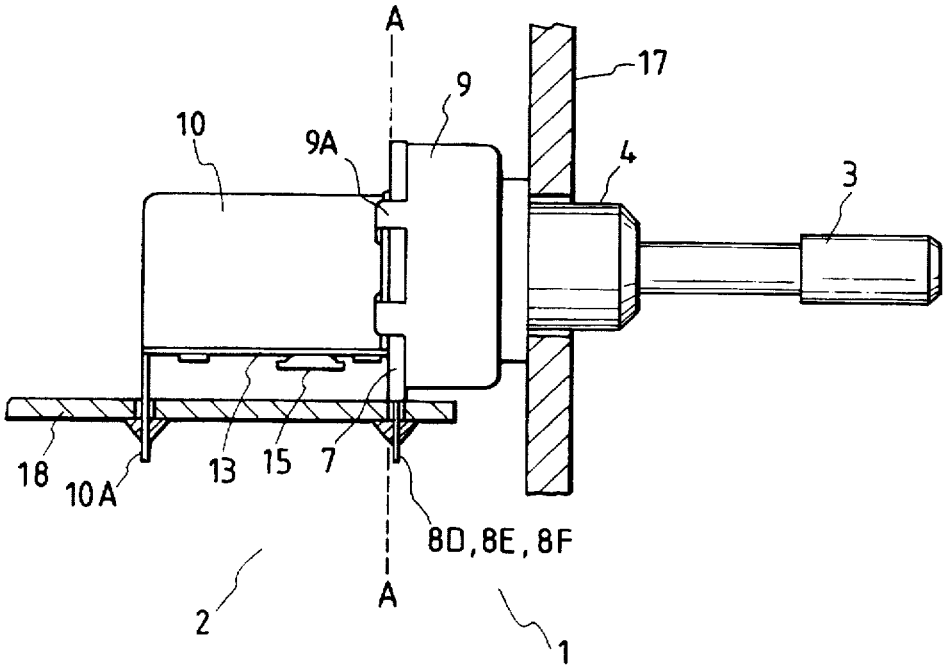
FIG. 16 PRIOR ART
FIG. 16 is a side view which shows a conventional rotary encoder.
Figure 17A:
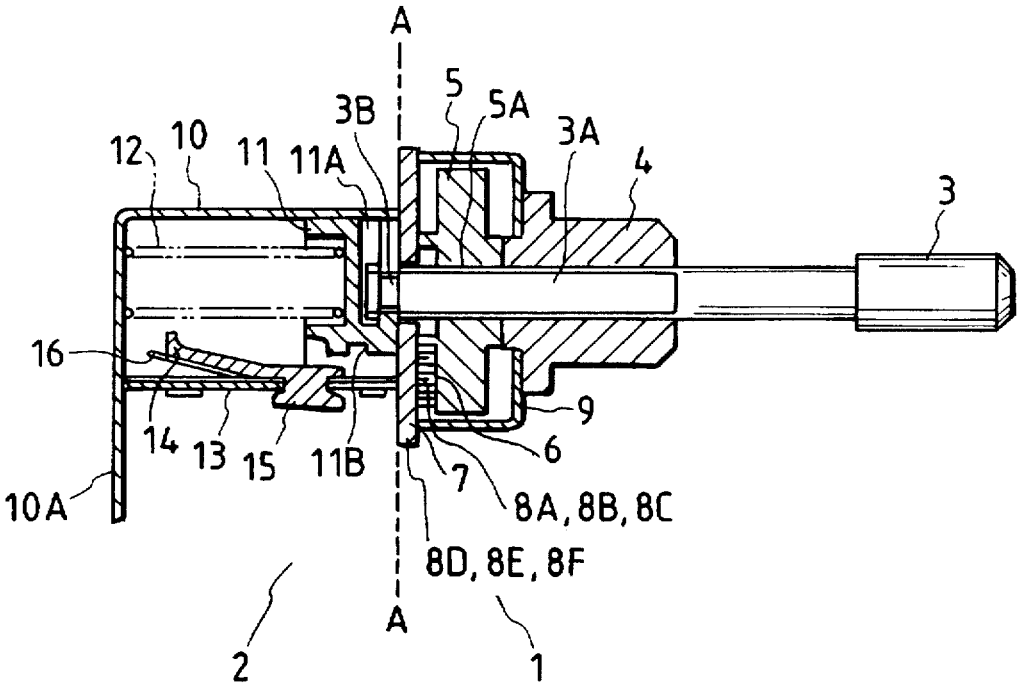
FIG. 17(a) PRIOR ART
FIG. 17(*a*) is a cross sectional view which shows an unlocked position of an operating shaft of the conventional rotary encoder in FIG. 16.
Figure 17B:
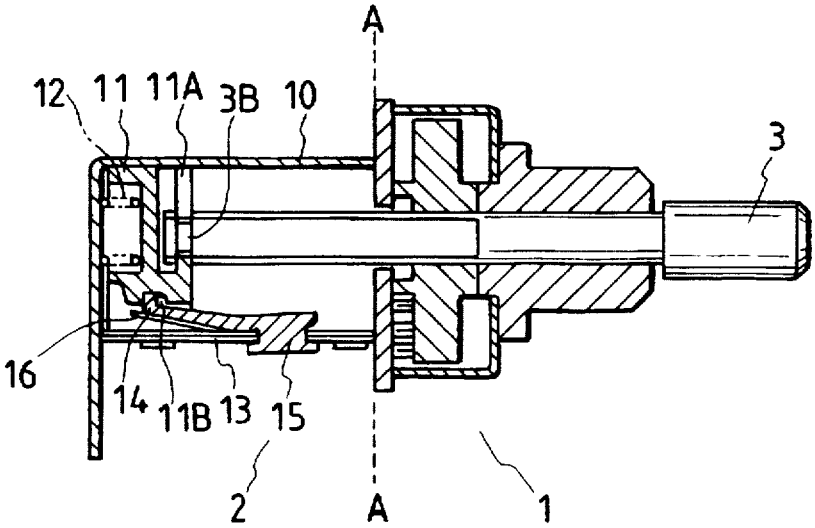
FIG. 17(b) PRIOR ART
Figure 18:
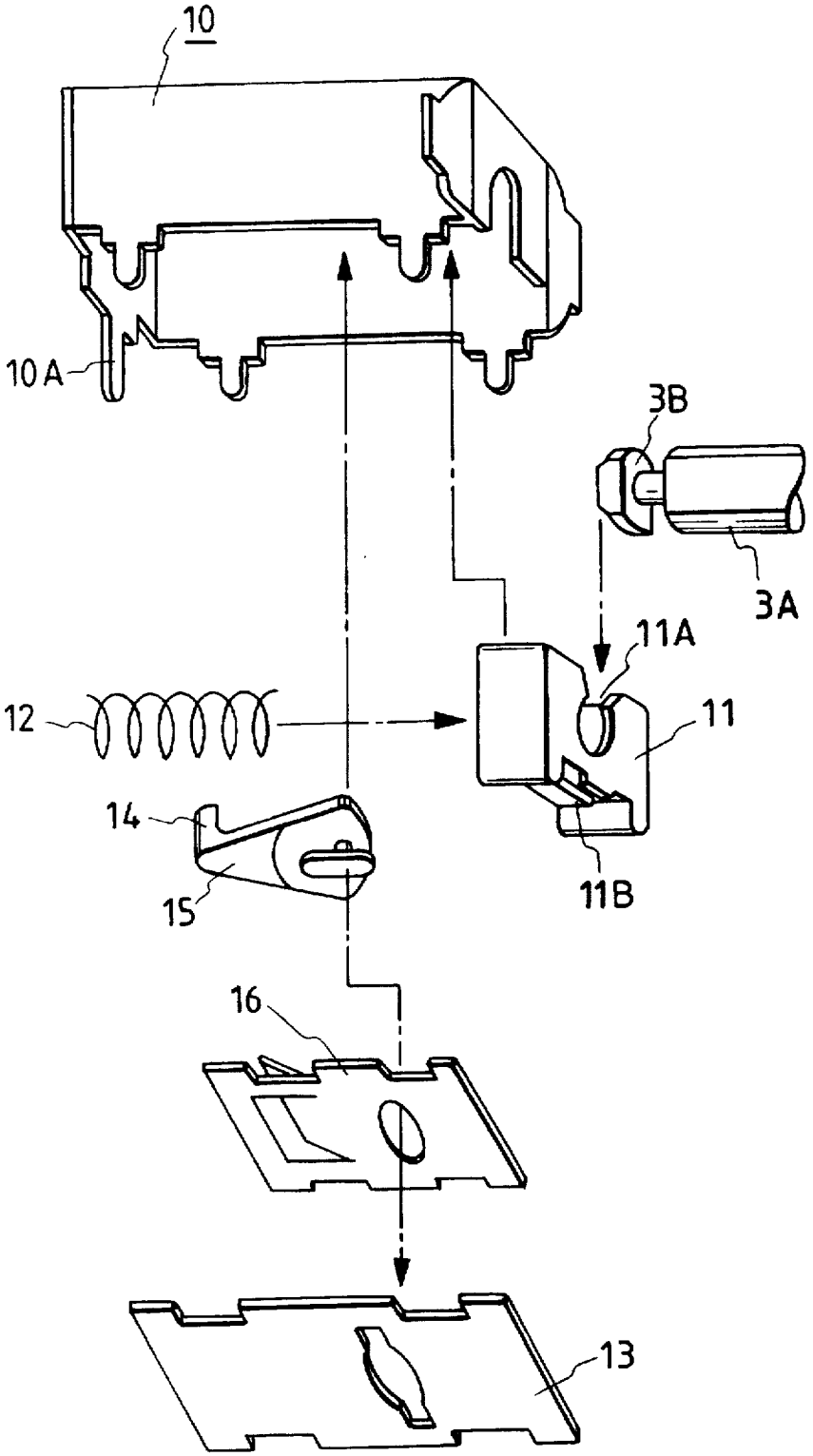
FIG. 18 PRIOR ART
FIG. 18 is an exploded perspective view which shows a locking mechanism of the conventional rotary encoder shown in FIG. 16.
Figure 19:
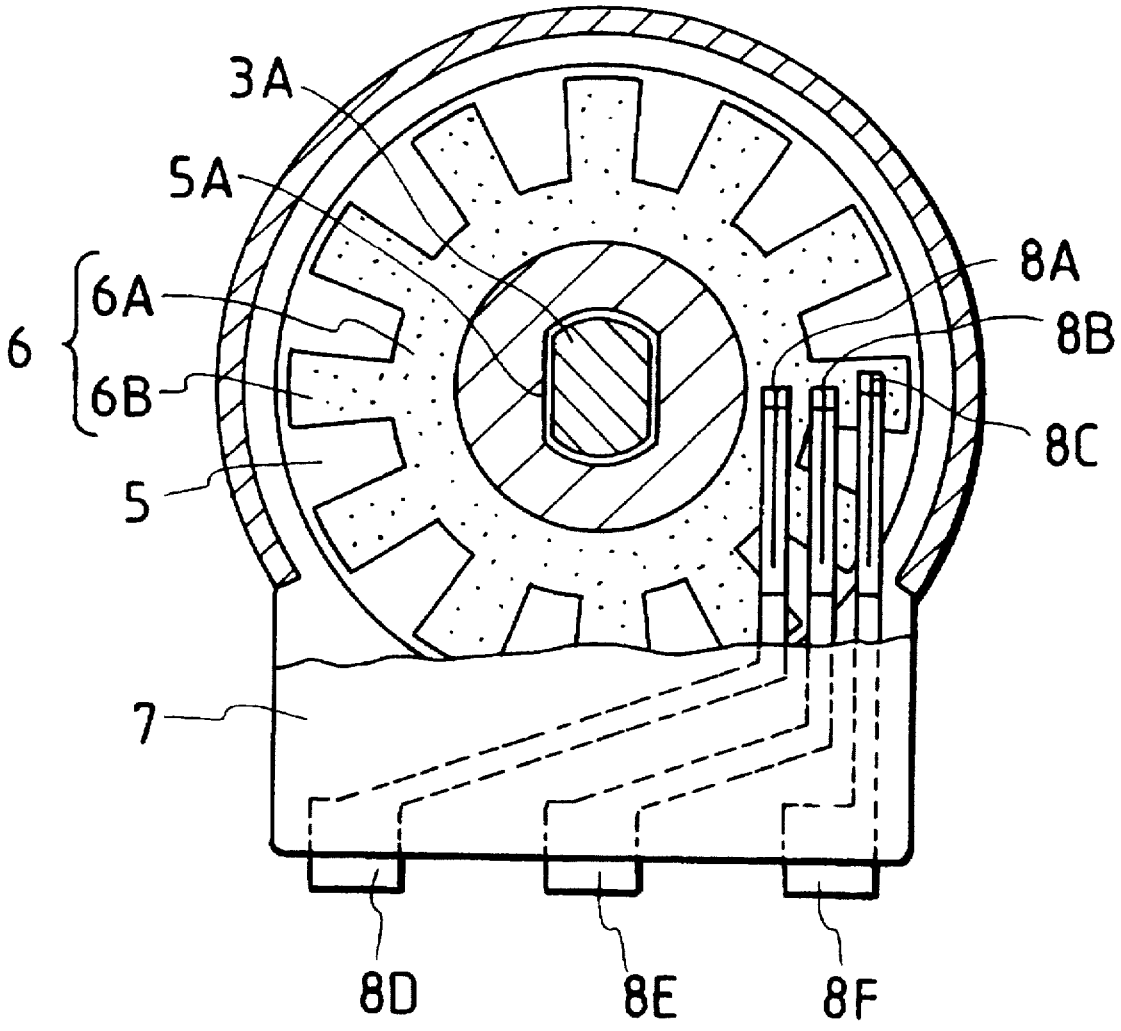
FIG. 19 PRIOR ART
FIG. 19 is a partially cross sectional bottom view which shows the conventional rotary encoder in FIG. 16.

In operation, when the push/turn operating shaft 39 is depressed inward, it will cause the fins 42 and the protrusions 42D of the rotary sliding member 41 to engage a front end surface of the boss 43B of the movable contact 43 to move it, as shown in FIG. 15, away from the stationary contacts 35A and 35B against the spring force of the coil spring 38, thereby blocking the electrical communication between the stationary contacts 35A and 35B. Upon release of the push/turn operating shaft 39, the rotary sliding member 41 is urged by the coil spring 38 in the right direction, as viewed in FIG. 15, and held in the locked position, similar to the above embodiments, while maintaining the electrical communications between the stationary contacts 35A and 35B blocked.

When the push/turn operating shaft 39 is depressed further from the locked position, it is returned back to the unlocked position in the same manner as discussed above. Upon movement of the push/turn operating shaft 39 to the unlocked position, the movable contact 43 and the rotary sliding member 41 are urged by the coil spring 38 in the right direction, as viewed in FIG. 15, to establish the electrical communications between the stationary contacts 35A and 35B again.

In this embodiment, the block of the electrical communication between the stationary contacts 35A and 35B is accomplished by pushing the movable contact 43 against the spring force of the coil spring 38 through end surfaces of the fins 42 and the protrusions 42D of the rotary sliding member 41, but it may also be accomplished by pushing the movable contact 43 only through the end surfaces of the fins 42.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

For example, the opposed guide grooves 26C and 26D formed in the cross-shaped hole 26 of the rotor 23 and the fins 29B and 42 are not limited in number to the above embodiments and may be increased in number to two times which is suitable for an increased diameter of the cross-shaped hole 26 of the rotor 23.

What is claimed is:

1. A rotary electronic device comprising:

a rotor having disposed thereon a rotary contact plate which establishes electrical communication with a plurality of contacts in response to rotation of said rotor;

a hole formed in said rotor extending along an axis of rotation of said rotor, said hole including a non-circular portion and a circular portion, the non-circular portion being defined by a plurality of ridges which are formed on an inner wall of said rotor and which extend along the axis of rotation of said rotor at a given interval away from each other to define a plurality of guide grooves therebetween, the ridges having slant end surfaces exposed to the circular portion, oriented at a given angle to the axis of rotation of said rotor;

an operating shaft disposed within said hole so as to be rotatable along with said rotor and movable in a direction of the axis of rotation of said rotor when axially displaced, said operating shaft including a small diameter portion and a large diameter portion, the large diameter portion having formed thereon a plurality of ridges extending in a lengthwise direction thereof engaging the guide grooves formed in the inner wall of said rotor, the ridges having wedge-shaped end surfaces exposed to the circular portion of said hole;

a rotary sliding member having an annular portion into which the small diameter portion of said operating shaft is fitted and a plurality of sliders formed on an outer wall of the annular portion, the sliders having tapered end surfaces oriented at an angle in the same direction of the slant end surfaces of the ridges formed on the inner wall of said rotor; and urging means between one end of said operating shaft and said rotary sliding member, for urging the tapered end surfaces of the sliders of said rotary sliding member into engagement with the wedge shaped end surfaces of said operating shaft and the slant end surfaces of the ridges formed on said inner wall of said rotor when said operating shaft is axially moved through said hole, said operating shaft being held in a locked state with said rotor when said sliders are engaging said ridges of said rotor inner wall, and said operating shaft being released in an unlocked state when said sliders are engaged with said rotor grooves.

2. A rotary electronic device as set forth in claim 1, further comprising a push/turn button provided on an end of said operating shaft, having a diameter greater than that of said operating shaft and a coil spring disposed between said rotor and the push/turn button for holding said operating shaft in the unlocked position.

3. A rotary electronic device as set forth in claim 2, wherein said push/turn button has formed therein a chamber within which an end portion of the coil spring is disposed.

4. A rotary electronic device as set forth in claim 1, wherein the non-circular portion of said hole and the large diameter portion of said operating shaft are of cross-shape and contoured to each other.

5. A rotary electronic device as set forth in claim 1, further comprising an insulating casing supporting said rotor rotatably and a switching assembly including a plurality of stationary contacts provided on and end surface of the insulating casing and a movable contact urged into constant engagement with the stationary contacts to establish electric communication between the stationary contacts, the movable contact being brought into disengagement from the stationary contacts by the movement of said operating shaft from the unlocked position to the locked position.

6. A rotary electronic device as set forth in claim 1, further comprising an insulating casing supporting said rotor rotatably and a switching assembly including a plurality of stationary contacts provided on and end surface of the insulating casing and a movable contact disposed within a casing connected to the insulating casing, urged into constant engagement with the stationary contacts to establish electric communication between the stationary contacts, the movable contact being moved by said rotary sliding member to be brought into disengagement from the stationary contacts according to the movement of said operating shaft from the unlocked position to the locked position.

* * * * *